US007128222B2

(12) United States Patent
Doucette

(10) Patent No.: US 7,128,222 B2
(45) Date of Patent: Oct. 31, 2006

(54) HANGER AND BACKCARD FOR PACKAGES

(75) Inventor: Daniel E. Doucette, Deforest, WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 226 days.

(21) Appl. No.: 10/670,010

(22) Filed: Sep. 24, 2003

(65) Prior Publication Data

US 2005/0061759 A1 Mar. 24, 2005

(51) Int. Cl.
*A47F 7/00* (2006.01)

(52) U.S. Cl. ..... 211/85.4

(58) Field of Classification Search ..... 211/85.4, 211/59.1, 57.1, 54.1, 72, 73; 206/459.5, 206/461, 806, 764; 40/124.01, 124.09, 663; 283/100, 103

See application file for complete search history.

(56) References Cited

U.S. PATENT DOCUMENTS

| | | | | |
|---|---|---|---|---|
| 10,739 A | | 4/1854 | Hart | |
| 999,961 A | | 8/1911 | Colas | |
| 1,223,013 A | | 4/1917 | Wilson | |
| 1,695,432 A | | 12/1928 | Lovejoy | |
| 1,806,149 A | | 5/1931 | Daugherty | |
| 2,023,542 A | | 12/1935 | Peck | |
| 2,042,799 A | | 6/1936 | Ort | |
| 2,635,604 A | | 4/1953 | Fredrickson | |
| 2,651,867 A | * | 9/1953 | Prew | 40/781 |
| 2,793,745 A | | 5/1957 | Cox, Jr. | |
| 2,803,390 A | | 8/1957 | MacKay | |
| 3,016,224 A | | 1/1962 | Hall | |
| 3,033,362 A | | 5/1962 | Marcalus | |
| 3,104,046 A | | 9/1963 | Arneson | |
| 3,387,732 A | | 6/1968 | Jellies | |
| 3,587,837 A | * | 6/1971 | Smith et al. | 206/387.11 |
| 3,616,096 A | | 10/1971 | Roeder | |
| 3,814,303 A | | 6/1974 | Smith | |
| 3,851,790 A | | 12/1974 | Kasper | |
| 3,884,350 A | | 5/1975 | Johansson | |
| 3,884,443 A | | 5/1975 | McMaster | |
| 3,958,744 A | * | 5/1976 | Herglotz | 229/100 |
| 4,016,977 A | | 4/1977 | Krautsack | |
| 4,121,755 A | | 10/1978 | Meseke et al. | |
| 4,179,138 A | | 12/1979 | Bogdanovic | |
| 4,184,597 A | | 1/1980 | Gavin | |
| 4,261,506 A | | 4/1981 | Scott | |

(Continued)

FOREIGN PATENT DOCUMENTS

CH 408 315 9/1966

(Continued)

*Primary Examiner*—Sarah Purol
(74) *Attorney, Agent, or Firm*—Fitch, Even, Tabin & Flannery

(57) ABSTRACT

A backcard for use with compartmentalized containers, particularly food containers, that provides a hanging feature and an information feature. The backcard may be secured to the container or package with glue lines properly placed on the package, or glue placed on the backcard. The hanging feature is formed by moving a tab located in an outermost sheet or layer from a non-extended position to an extended position. The backcard is provided with a substantial area, e.g., 50% or more of the backcard area, for printing information such as a list of nutritional facts, a list of food ingredients and the like for presentation to a consumer. In addition, a portion of the backcard may be removable or foldable to expose a portion of the outer layer or a substrate layer, thereby allowing each to display additional information.

19 Claims, 5 Drawing Sheets

U.S. PATENT DOCUMENTS 4,266,671 A 5/1981 Roccaforte
4,279,376 A 7/1981 Roccaforte
4,541,598 A 9/1985 Villanueva et al.
4,572,380 A 2/1986 Langwell
4,693,441 A 9/1987 Conway
4,718,627 A 1/1988 Fast et al.
4,793,486 A 12/1988 Konopka et al.
4,832,301 A 5/1989 Hiramoto et al.
4,838,424 A * 6/1989 Petzelt ..... 206/459.5
4,863,128 A 9/1989 Good
4,865,204 A 9/1989 Vance
4,919,377 A 4/1990 Alexander et al.
5,020,761 A 6/1991 Good et al.
5,048,676 A 9/1991 Borgis et al.
5,119,940 A * 6/1992 Grindrod ..... 426/120
5,123,527 A * 6/1992 Hustad ..... 206/769
5,184,724 A 2/1993 Mayled
5,328,137 A 7/1994 Miller et al.
5,375,701 A * 12/1994 Hustad et al. ..... 206/542
5,570,782 A * 11/1996 Kikuchi et al. ..... 206/308.3
5,657,873 A * 8/1997 Hustad et al. ..... 206/764
5,657,874 A * 8/1997 Hustad et al. ..... 206/764
5,743,403 A 4/1998 Crysdale
5,842,632 A 12/1998 Van Hest
5,975,415 A 11/1999 Zehnal
6,145,659 A 11/2000 Faircloth et al.
6,234,477 B1 * 5/2001 Scrymgeour et al. ..... 273/139
D443,510 S * 6/2001 Doucette ..... D9/425
D471,766 S * 3/2003 Bradley et al. ..... D7/553.2

FOREIGN PATENT DOCUMENTS

DE 28 06 391 A1 8/1978
FR 1.460.738 12/1966
GB 1175296 12/1969
GB 1309950 3/1973

* cited by examiner

HANGER AND BACKCARD FOR PACKAGES

FIELD OF THE INVENTION

The invention relates to a backcard, and more particularly, to a backcard attachable to a package and having a hanging feature and an information feature.

BACKGROUND OF THE INVENTION

Containers or "kits" for food products often include a base with several compartments, each containing a separate food product. For instance, one compartment may contain cheese intended to be spread on crackers contained in a second compartment. A third compartment may include cookies or a dessert item intended to be consumed separately from the cheese and crackers.

These types of containers often have molded plastic or polymeric material forming the compartments. The containers are constructed such that the compartments form walls separating the food products. The food products are placed in the compartments, and a cover is applied to the compartments. The cover is sealed to the walls so that each food product is isolated from the environment outside of the container and is isolated from each other food product.

The cover is often intended to be the front or top of the package, and may be at least partially clear so that some or all of the food products are substantially visible. This enables a potential purchaser or consumer to examine the package and readily view some of the contents of the container.

In addition, the cover may be used to display pertinent information regarding the food product. The cover may present information such as ingredients, a trade or retail name, a manufacturer name, instructions for using and combining the package contents, and other information that is either desirable from a marketing perspective or required from a legal standpoint. Backcards are often used to provide nutritional facts, lists of ingredients, bar codes, and other information.

Commercial food containers generally must be capable of inexpensive manufacture. The amount of material for the container should be limited to reduce cost. In addition, economical manufacturing processes for the container are preferred.

Retail food containers or packages should be easy to open and use properly. Although some of the food product in the compartments may be relatively secure, such as cheese spread, some of the food product may be loose, such as crackers or sprinkles for a dessert item. When the cover and seal are peeled open, the base portion of the container may be flexed by the pulling of the cover. This may lead to spillage during peeling or after the peeling force is released by the separation of the cover from the base if the package is not sufficiently rigid.

Retail display of these packages has intertwined aesthetic and functional aspects. Generally, the packages are intended to be attractive to customers, and in some cases, as noted above, the packages permit a potential purchaser to view the contents. Some packages are displayed on shelves, on end with the cover at the front of the display to be readily visible to the consumer. In other instances, packages are hung from a rod or peg, again with the cover facing forward. In both cases, features generally must be provided to enable the packages to be supported in the desired orientation, while also enabling the packages to be formed, filled and sealed economically in commercial mass production.

It is known to have merchandise display hangers that are adhesively attached to video cassettes or the like and have a fold-out hanging portion with an aperture therein for hanging on a rod or hook, as disclosed in U.S. Pat. Nos. 5,328,137 and 4,832,301. The hanging portion is centrally located in the flat hanger sheet and occupies a very substantial portion of the hanger body. In the hanger of U.S. Pat. No. 5,328,137, an opening or gap is provided in the bottom edge to facilitate grasping of the lower end of the fold-out, hanging portion. This gap extends throughout the height of the bottom section to the bottom edge of the fold-out, hanging portion. When the fold out hanging portion is grasped and swung upwardly and out of the plane of the body, two legs are left on the body. The legs and a small strip on the inner side of the hanger body are available for adhering the hanger body to the video cassette, but cover only a top portion of the video cassette, and hence do not function as a backcard nor as a large surface area for bearing indicia.

SUMMARY

In accordance with an embodiment of the invention, there is provided a new and improved backcard and a new and improved combination of a backcard and a food container having a hanging feature and a substantial informational area for receiving and/or having indicia thereon relating to the food product in the container. This is achieved by a backcard that has a hanging feature that is provided in an upper portion of the backcard and a lower half of the card being substantially without holes therein and bearing informational indicia related to the food product. The preferred embodiment comprises an inner layer or ply that is adhered to the container and an outer layer or ply having the hanging feature and bearing the indicia.

In one embodiment, the two layers are substantially rectangular in shape and have a hanging feature which is pulled out of the plane of the outer ply adjacent an upper edge of the backcard and pivoted upwardly about a fold line adjacent the upper edge of the card with the portion of the outer layer therebelow being planar and without any substantial voids or holes and bearing printed indicia describing the contents of the food products.

In accordance with a further embodiment, a tear strip is formed in the outer ply and is tearable to provide access to the interior of the backcard. By tearing the strip, access may be had to indicia related to prizes or coupons.

In an exemplary embodiment, a plastic container is provided with separate compartments, each containing a food product therein with the separated bases of the compartments being adhesively joined to the backcard and with a cover sheet adhered to the container to cover the food access openings to the respective compartments. The cover sheet may have transparent portions allowing viewing of the food products in the container and some area for having graphics including printed indicia identifying the food product. The hanging backcard may have a large area, for example, 50% or more, which is available for graphics including printing relating to contents of the container, bar codes, etc. The container may be laid flat with the hanging feature remaining within the plane of the backcard, or the hanging feature may be pulled from the plane of the backcard along weakened lines to fold it upwardly for attachment to a hanger rod or hook.

DETAILED DESCRIPTION OF PREFERRED EMBODIMENTS

Figure 1:
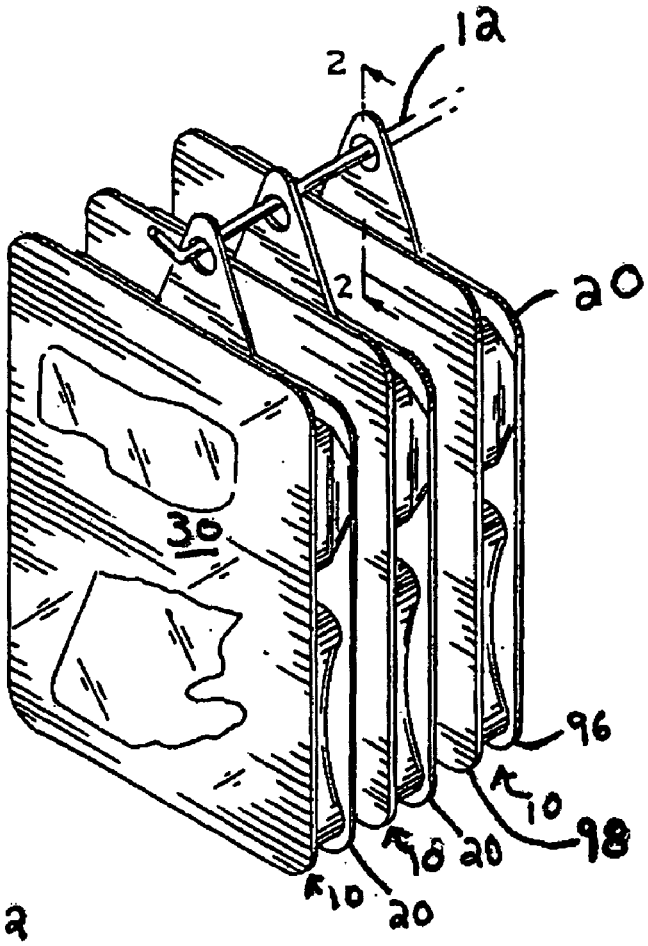
FIG. 1 is a perspective view of a plurality of packages utilizing an embodiment of the invention.

Referring initially to FIG. 1, a series of hanging packages 10 are depicted hanging from a rod 12 used for the display of products in a store. Each package 10 is hung from the rod 12 with a backcard 20. The backcard 20 is secured, preferably by an adhesive such as glue, to the back 22 of the hanging package 10 (see FIG. 9). As depicted, the preferred backcard 20 is generally rectangular in shape, though it may be of any shape such as square, oval, polygonal, or circular.

Figure 9:
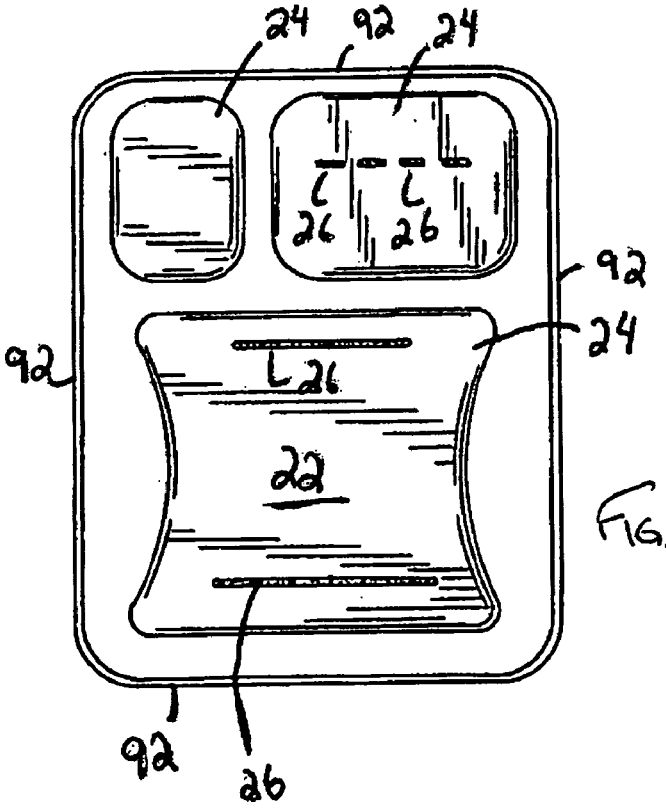
FIG. 9 is a rear elevation view of the package of FIG. 1, without the backcard.

The hanging packages 10 preferably used with the backcard 20 are multi-compartment packages for storing different food items that a user may eat separately or may combine prior to eating. The back 22 of the package 10 has an irregular shape due to the shape of the compartments 24. As can be seen in FIG. 9, glue lines 26 are made across a plurality of the compartments 24, and the backcard 20 is secured using these glue lines 26. Alternatively, the backcard 20 may be provided with adhesive lines, and the backcard 20 may then be applied to the package 10. A greater degree of precision may be required with securing the package 10 and backcard 20 in this manner. As a further alternative, one side of the backcard 20 may be entirely covered with adhesive or glue.

While it may be difficult to print information on the back 22 of the package 10, utilization of the backcard 20 allows information to be easily placed on the back of the package 10 by printing information on the backcard 20 and gluing it to the package 10. The front 30 of the package 10 may comprise clear cellophane or the like so that the contents are easily discerned by a consumer. By placing information on the backcard 20, the front 30 of the package 10 is not cluttered with this information and the contents of the package 10 are minimally obscured.

Figure 4:
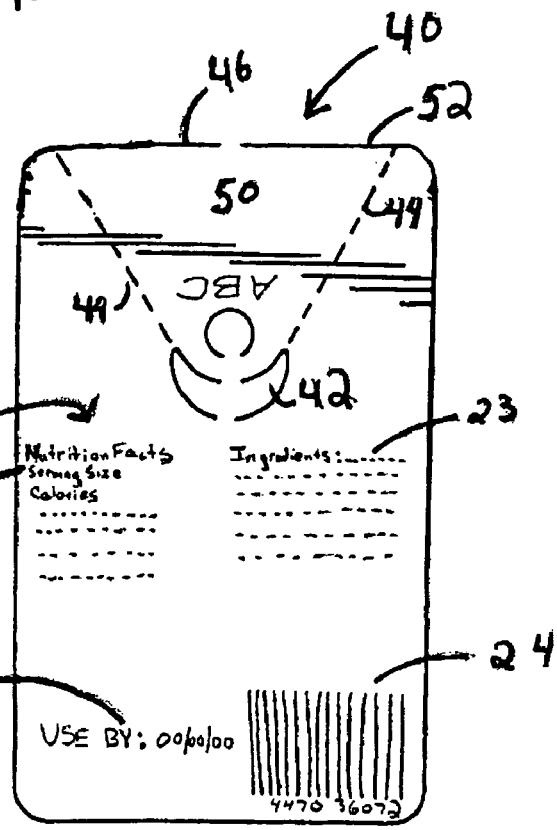
FIG. 4 is a rear elevation view a second embodiment.

In accordance with a preferred embodiment, the backcard 20 functions not only to hang the product, but also to provide a large, contiguous area for printed information or indicia 21 such as a list of nutritional facts 22 on the left side of the backcard, a list of ingredients 23 in a column on the right side of the backcard, a bar code 24, and a date 25 at the bottom of the backcard, as depicted in FIG. 4. Thus, there is provided a combined backcard 20 and hanger card for hanging the product and for displaying the ingredients, nutritional facts, etc. for the product. Manifestly, the indicia 21 may vary substantially from that described above by way of example. The entire lower portion of the card is substantially without holes or voids that would interfere with the printing of the indicia 21. Preferably, the hanging feature or tab uses only a small upper end or portion of the backcard so that a major portion of the outer surface of the backcard is available for printing of indicia. In the illustrated embodiment, the hanging feature comprises less than ⅓ of the backcard area, and may, for example, comprise about 10%–20% thereof.

Figure 2:
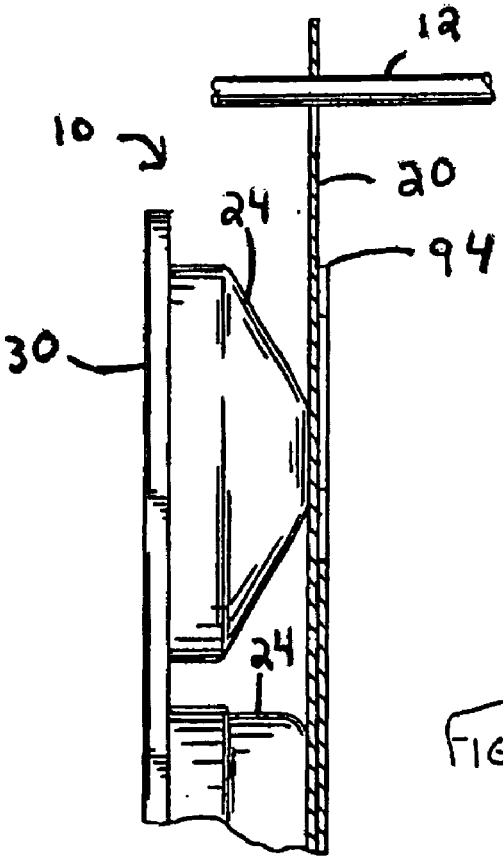
FIG. 2 is a fragmentary side elevation view of the package of FIG. 1.
Figure 3:
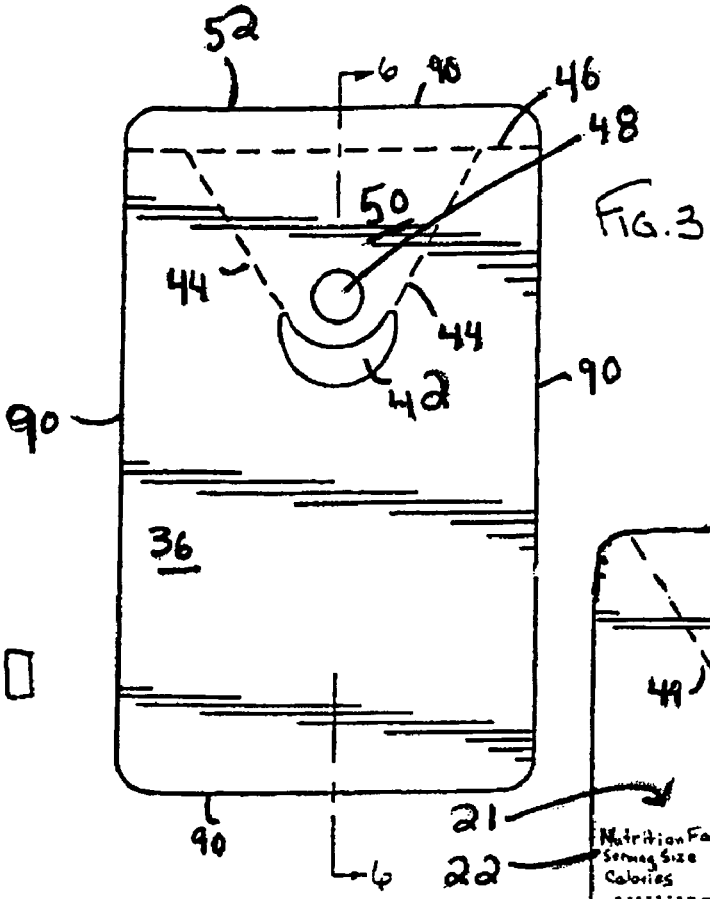
FIG. 3 is a rear elevation view of the backcard of FIG. 1.

The preferred backcard 20 is a two-ply or two sheet card. As can be seen in FIGS. 3–8, the backcard 20 has a substrate layer 34 and an outer layer 36. The substrate layer 34 receives the glue that secures the backcard 20 to the package 10, as can be seen in FIG. 2. The outer layer 36 is the layer that preferably receives the information that is to be displayed to the consumer as it is the visible layer and as it generally covers the substrate layer 34.

Figure 5:
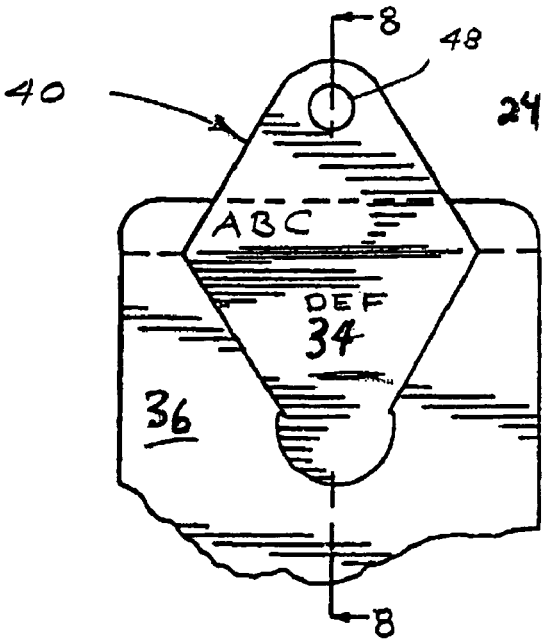
FIG. 5 is a fragmentary rear elevation view of the backcard of FIG. 3.
Figure 7:
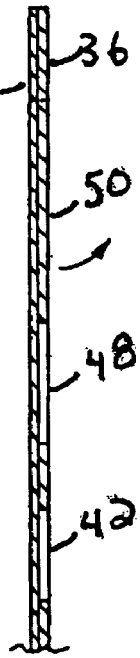
FIG. 7 is an enlarged fragmentary cross-section corresponding to FIG. 6.

A hanging feature 40 is provided near the upper end of the backcard 20. The hanging feature 40 includes a finger hole 42, a pair of scores or perforated lines 44, a crease or fold line 46, and a punch hole 48, all in the outer layer 36 only, together forming tab 50. A user may insert a finger or other object into the finger hole 42 to engage the tab 50. The tab 50 is then pulled, causing separation of the perforation lines 44 and folding of the fold line 46. Thus, the tab 50 may be extended as is shown in FIG. 5. A principal utility of the perforated lines 44 is to mechanically hold the tab 50 in a recessed and non-extended position such as depicted in FIG. 7, a result that may also be achieved by utilizing a peelable adhesive or other means for holding the tab 50 in such position. Although shown offset from a top edge 52 of the backcard 20 in FIG. 3, the tab 50 may also be located so that the top edge 52 and fold line 46 are coincident, as can be seen in FIG. 4. The backcard 20 may also be a single-ply or single sheet card, in which case the glue lines 26 between the backcard 20 and the package 10 should be located such that the operation of the hanging feature 40 is not retarded or prevented.

Figure 6:
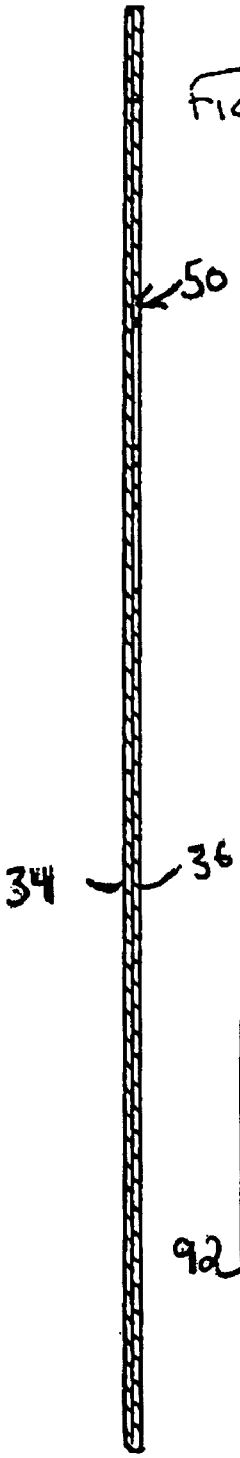
FIG. 6 is a cross-section taken along line 6—6 of FIG. 3.
Figure 8:
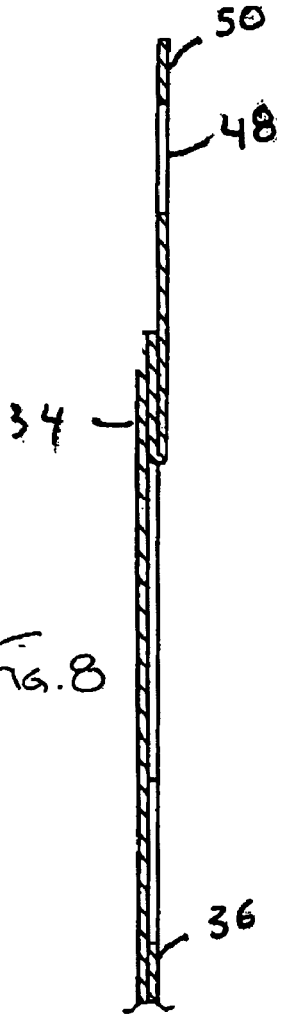
FIG. 8 is a cross-section taken along line 8—8 of FIG. 5.

Referring to FIG. 6, the two-ply backcard 20 is depicted with the tab 50 in a non-extended position. The arrow in FIG. 7 depicts the direction in which the tab 50 is to be moved to the extended position, as is shown in FIG. 8. By utilizing a tab 50 and hanging feature 40 in this manner, the backcard 20 and package 10 may be conveyed in a manufacturing setting, shipped in cases, and displayed at retail without protrusions to interfere with these activities. It is only through the retailer deciding that the tab 50 is to be used that the tab 50 is extended. In the event the retailer displays the packages 10 on a shelf, the tab 50 may remain in its original position, wherein the hang tab 40 does not protrude beyond the surrounding backcard material. This enables the packages to be arranged stably in a stack without interference from the hanging feature.

As shown in FIGS. 4 and 5, information such as promotional information may be printed on one or more of the inner and outer surfaces of the hang tab 50, and/or on the portion of substrate layer 34 that is exposed when the tab 50 is pulled up.

Figure 10:
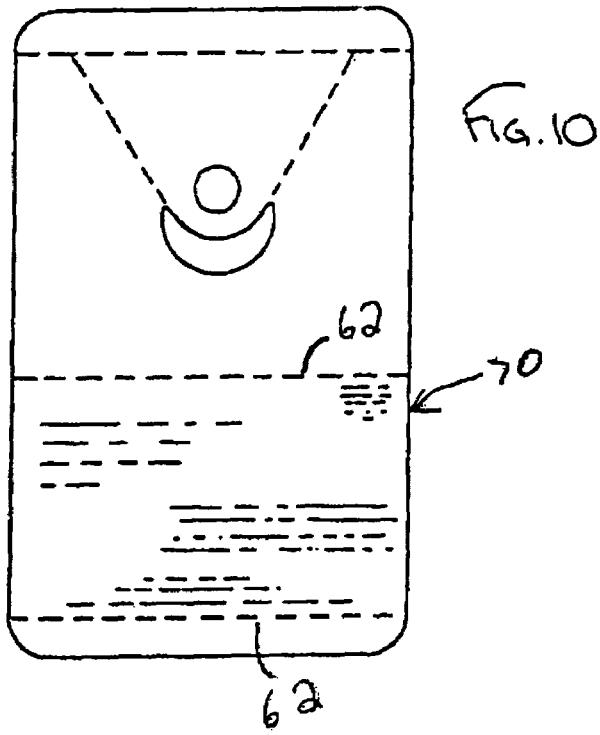
FIG. 10 is a rear elevation view of a further embodiment.
Figure 11:
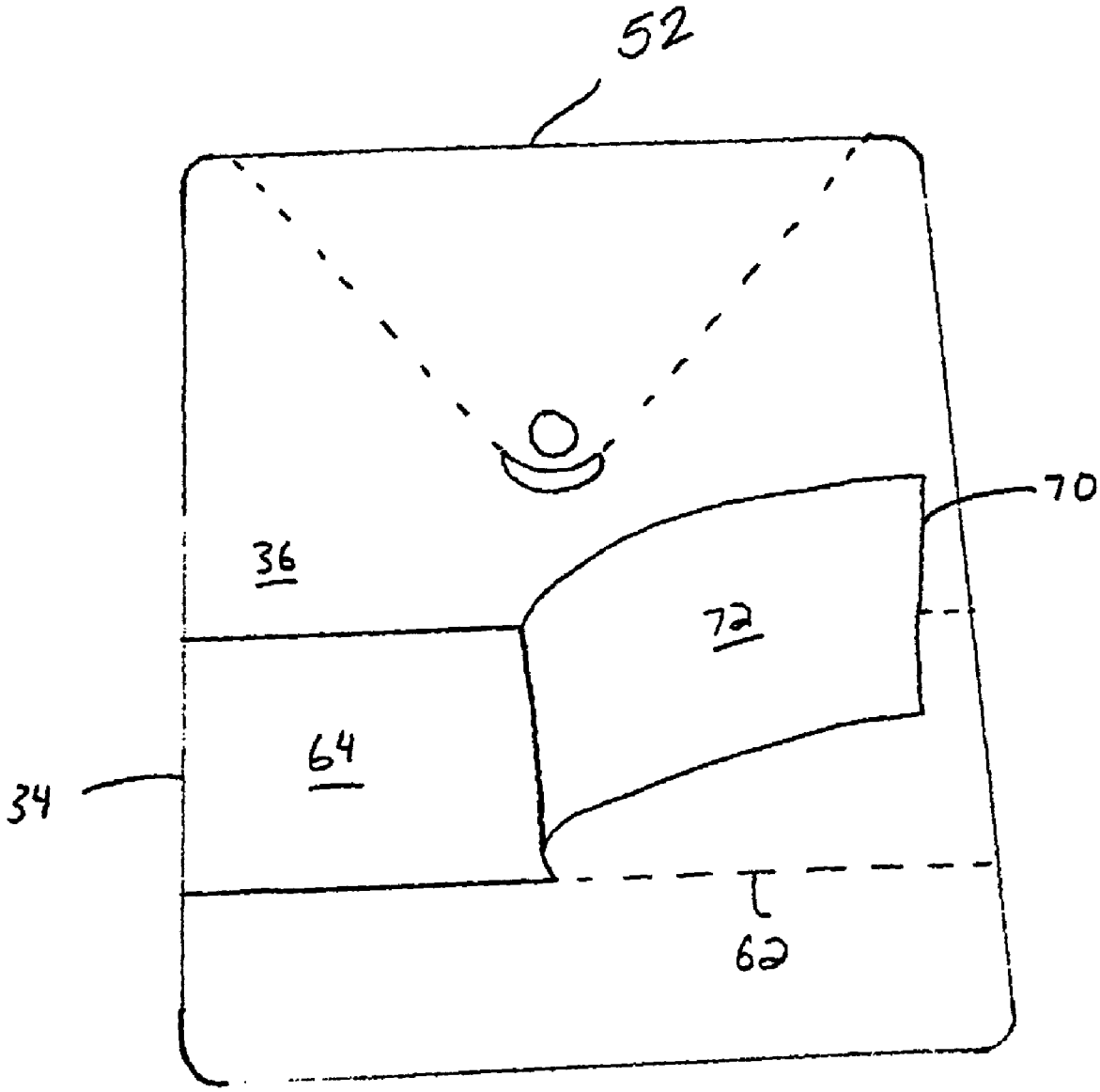
FIG. 11 is a perspective view of the backcard of FIG. 10 with the removable portion partially removed.

As an alternative to or in conjunction with one of the above-described embodiments, a surface 64 of the substrate layer 34 (see FIG. 11) may be exposed when a portion 70 of the outer layer 36 is partially or completely removed. Referring to FIG. 10, the outer layer 36 is shown with score lines 62. The score lines 62 are located in a position so that their use does not interfere with the operation of the hanging feature 40. In FIG. 11, the portion 70 of the outer layer 36 bounded by the score lines 62 is shown partially removed. The portion 70 may have information printed on the surface 72 such that the information is only visible when the portion 70 is partially or completely removed. Such information may be related to a prize or sweepstakes and/or to a coupon's legal disclosure information, for instance. The surface 64 may also contain information. In other embodiments, the entirety of the outer layer 36 may be folded up, such as along the top edge 52, to expose the entirety of the substrate layer 34.

Figure 12:
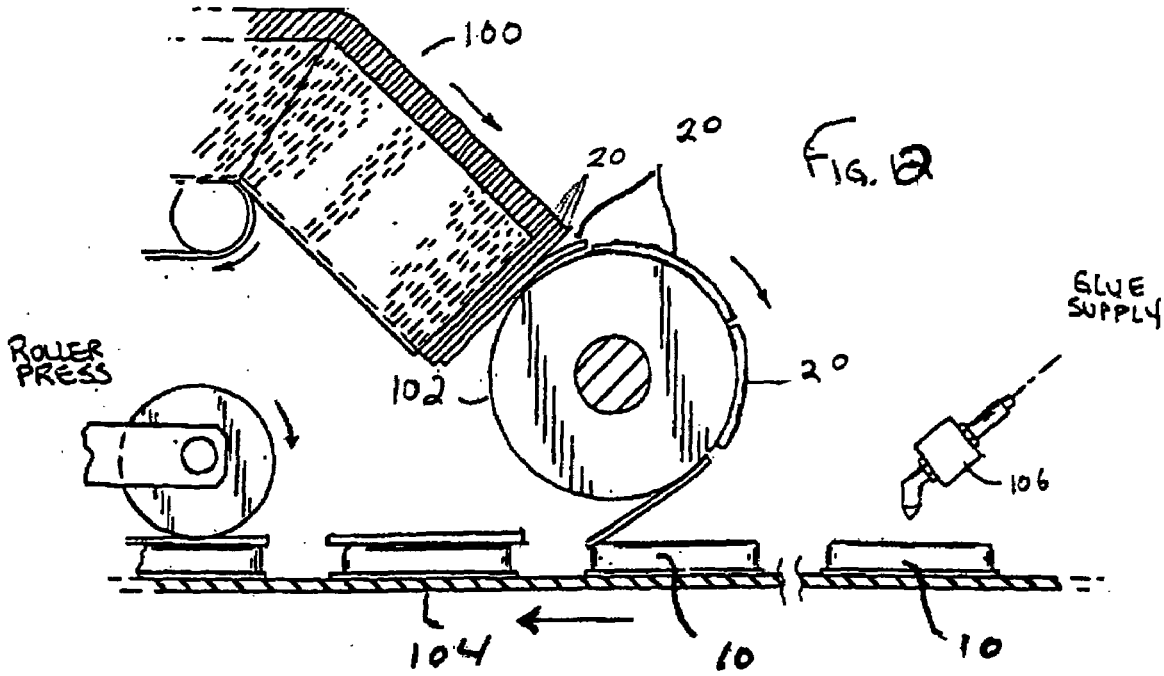
FIG. 12 is a representation of a manufacturing process for securing backcards to packages.

The printed backcards 20 may be secured to the package 10 by a method and apparatus as shown in FIG. 12. A supply 100 of backcards 20 is provided adjacent a vacuum roller 102. The packages 10 may be advanced continuously at a constant speed or otherwise along a conveyor 104 so that the packages 10 pass under a glue supply 106 and then under the spinning roller 102 so that a backcard 20 is placed on the glue. The glue supply 106 can provide glue lines 26, at selected locations on the compartments 24.

In a preferred embodiment, the backcard 20 is made from Solid Bleach Sulfate (SBS) paper. Although any weight of paper could be used, 8 lb. paper is preferred such that the two layers of the backcard 20 are equivalent to 16 lb. paper. Stiffness generally decreases if the backcard 20 is lower than equivalent of 16 lb., while greater than 16 lb. may unacceptably increase the cost of the backcard 20. The backcard 20 may include a coating of polypropylene providing additional strength. Alternatively, the backcard 20 may include a coating of a ultraviolet (UV) varnish, or acrylic, or a layer of ink, each of which may contribute properties to protect the product contained in the package, to protect the packaging itself, or to improve or protect the printing of the indicia on the backcard 20. For instance, printing is usually placed on a coated side of the paper.

The coating on the backcard 20 further has a role in the above-described manufacturing process. The process includes applying backcards 20 to packages 10 at a rate of approximately 300 per minute. In order for this rate to be maintained, the backcards 20 need to remain somewhat flat. Specifically, curling of the backcard 20 by as little as ¼ of an inch may reduce the rate at which the cards can reliably be picked up by suction or otherwise handled. Curling in one form is a result of moisture content and absorption, more precisely an imbalance of moisture content between two portions of the card. Moisture can be introduced through the environment of the backcard 20, or through a process such as application of adhesive to one or more layers of the backcard to secure it to the package or to secure the layers to each other. Curling may result from one side or one layer of the backcard 20 absorbing more water than the other side or layer absorbs. The presence of the coating may retard moisture absorption, thereby causing an uncoated side to have a greater absorption and the card to have a concomitant curling. Though paper coated on both sides may be used, this may add additional cost to the backcard 20. However, the coating on the backcard 20 may also be used to control curling. For instance, applying adhesive only to a coated side of the paper may result in less moisture absorption than application of adhesive to an uncoated side.

Curling is believed to be a result of moisture absorption by the fibers of the paper stock of the backcard 20. As they absorb water or moisture, the fibers swell. When the fibers of a first layer or ply swell more than those of a second layer, the first layer becomes larger than the second layer to which it is secured, thereby causing curl. For any particular fiber with a length much greater than its width or girth, the swelling may cause expansion in relation to the fiber's dimensions such that the fiber lengthens more than it widens. For the manufacturing process discussed above, curling in the backcard 20 in the lateral directions may be a greater problem than curling in the longitudinal direction. As the majority of the paper stock fibers are aligned with the paper's machine direction, curling in the lateral direction may be reduced by having the machine direction aligned with the longitudinal direction of the backcard 20.

Preferably, the outer edges 90 of the backcard 20 (FIG. 3) do not extend beyond the outer edges 92 (FIG. 9) of the package 10. The height 94 of the backcard 20, when secured, should be such that an extended tab 50 may be placed on a peg or rod 12 (see FIG. 1) while the package 10 has clearance below the rod 12. The bottom 96 of the backcard 20 is preferably even with the bottom edge 98 of the package 10 so that the package 10, with the backcard 20, may be placed on an even surface (not shown) and stood upright.

The backcard 20 may be applied to the package 10 before or after contents are placed in the compartments 24. The contents are placed in the compartments 24 prior to applying the front cover 30, which may be made of a heat sealable laminated polymeric material, cellophane, or other suitable material. Adding the backcard 20 before the contents are added and before the front 30 is secured may provide advantages relating to mechanical and/or thermal stability.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. A backcard for hanging and for providing information about an article to be hung comprising:

a card body;

an inner layer for attaching to an article;

an outer layer secured to the inner layer having an upper portion and a lower portion;

a hanging feature in the upper portion of the outer layer which is movable from a position in the plane of the outer layer to an extended position out of the plane of the outer layer for hanging the card and the article attached thereto;

a lower half of the card having a surface for receiving indicia thereon; and indicia related to the article covering a substantial area of the lower portion of the back card related to the article.

2. A backcard in accordance with claim 1 wherein the inner layer covers the area behind the hanging feature when the hanging feature is in its extended position.

3. A backcard in accordance with claim 1 wherein the indicia covers at least one-half of the outer layer of the backcard.

4. A backcard in accordance with claim 1 wherein:

a cut out portion in the outer layer adjacent the hanging feature allows grasping of the hanging feature and pulling it outwardly to its extended position.

5. A backcard in accordance with claim 4 wherein the hanging feature comprises:

a hanging tab formed in the outer layer and having edges formed by weakened lines which tear to separate the tab from the outer layer as the tab is pulled away from the inner layer and into the extended position.

6. A backcard in accordance with claim 1 comprising:

a fold line joining the hanging feature to the outer layer adjacent an upper edge of the backcard.

7. A backcard in accordance with claim 1 comprising:

a tear strip in the outer layer which is tearable to provide access to beneath the outer layer.

8. A backcard in accordance with claim 7 comprising:

indicia located behind the tearable strip and hidden by the tear strip until the tear strip is torn.

9. A backcard in accordance with claim 8 wherein:

the indicia is on the inner layer and is revealed by tearing the tear strip.

10. A combination of a backcard and food product container comprising:

a molded plastic container comprising a top wall and a plurality of separate compartments each containing a food product therein;

a removable cover over said top wall and said compartments, said cover having transparent portions to allow viewing of food product;

a separate bottom wall on each of the container compartments;

a common backcard adhesively secured to the bottom walls of each of the compartments to provide a bottom support surface covering most of the bottom of the container;

a hanging feature in the backcard that does not protrude beyond surrounding backcard material, allowing the container to be laid flat on a planar surface, said hanging feature capable of being pulled outward from the adjacent backcard material and pivoted about 180° to allow the container to be hung therefrom;

a portion of the backcard being planar and free of holes; and indicia related to the food product being present on the major portion of the backcard.

11. A combination in accordance with claim 10 wherein the backcard is substantially rectangular and free of holes therein except as related to the hanging feature.

12. A combination in accordance with claim 10 comprising:

an adhesive joining each of the compartment bottom walls to the card.

13. A combination in accordance with claim 10 wherein the backcard comprises:

an inner layer and an outer layer; and the outer layer having the hanging feature therein and having indicia thereon.

14. A combination in accordance with claim 10 comprising:

a tear strip in the backcard for tearing from the backcard.

15. A combination in accordance with claim 10 wherein the indicia comprises:

a list of nutritional facts about the food product; and a list of ingredients for the food products in the compartments.

16. A combination in accordance with claim 14 wherein the tear strip is adapted to be torn away to reveal promotional information.

17. A combination in accordance with claim 13 wherein the hanging feature comprises a generally triangular hang tab having a foldable base line.

18. A combination in accordance with claim 17 wherein said hang tab is capable of extending beyond an edge of adjacent backcard material after being pulled outward and pivoted about 180°.

19. A combination in accordance with claim 18 wherein said backcard further comprises promotional information on inner and outer surfaces of said hang tab, and on the inner layer at a location viewable only after the hang tab is pulled outward.

* * * * *